US007918175B2

(12) United States Patent
Orlebeke

(10) Patent No.: US 7,918,175 B2
(45) Date of Patent: Apr. 5, 2011

(54) MAST TRACK EXTENSION AND PRE-FEEDER FOR MAINSAIL FURLING

(76) Inventor: Steven Daniel Orlebeke, Hartford, WI (US)

( * ) Notice: Subject to any disclaimer, the term of this patent is extended or adjusted under 35 U.S.C. 154(b) by 84 days.

(21) Appl. No.: 12/235,589

(22) Filed: Sep. 22, 2008

(65) Prior Publication Data

US 2009/0078184 A1 Mar. 26, 2009

Related U.S. Application Data

(60) Provisional application No. 60/974,018, filed on Sep. 20, 2007.

(51) Int. Cl.
*B63B 15/00* (2006.01)
*B63H 9/10* (2006.01)

(52) U.S. Cl. ..... 114/90

(58) Field of Classification Search ..... 114/90, 114/101, 102.1, 102.12, 102.15, 102.16, 114/102.22, 102.29, 104, 106, 108, 112
See application file for complete search history.

(56) References Cited

U.S. PATENT DOCUMENTS

| | | | | |
|---|---|---|---|---|
| 4,418,632 | A | 12/1983 | Yoshimi et al. | |
| 5,640,919 | A | 6/1997 | Huisman | |
| 5,697,314 | A * | 12/1997 | Clausin | 114/106 |
| 6,371,037 | B1 | 4/2002 | Cook et al. | |
| 6,766,753 | B2 * | 7/2004 | Pierson | 114/106 |

OTHER PUBLICATIONS

International Search Report for PCT Application claiming priority to present application.

* cited by examiner

*Primary Examiner* — Daniel V Venne
(74) *Attorney, Agent, or Firm* — Alan R. Stewart; Godfrey & Kahn, S.C.

(57) ABSTRACT

A flexible mast track extension for use on sail boat mast permitting the luff of a sail bent to the mast to deflect from the line of the mast and facilitate the extension or retraction of a sail from a furling apparatus.

5 Claims, 6 Drawing Sheets

MAST TRACK EXTENSION AND PRE-FEEDER FOR MAINSAIL FURLING

CROSS REFERENCE TO RELATED APPLICATION

The present application claims priority to U.S. Provisional Patent Application Ser. No. 60/974,018, filed on Sep. 20, 2007, the disclosure of which is incorporated herein by reference.

BACKGROUND

The present disclosure relates to a pre-feeder to assist with the transition of a mainsail between a furled condition adjacent the boom to a raised position along a mast.

Furling of a mainsail has been accomplished in a number of ways conventionally. Furling may be done to reef or shorten sail to accommodate wind conditions or it may be done to take down the mainsail for storage. One conventional approach to furling a mainsail is to provide a mechanism, typically incorporated into the boom, that permits the mainsail to be rolled up, such as about a mandrel. Such a furling method permits reefing of the mainsail in a fashion very similar to more traditional slab reefing. Storage of the mainsail with boom furling is also very similar to traditional flaking of the mainsail on the boom for storage.

Conventional approaches to mainsail furling have also permitted boats to be managed with a smaller number of crew than might otherwise conventionally be required. When raising a mainsail conventionally, such as one which has been flaked over the boom, a crew member is typically required to be stationed at the mast to aid the boltrope as it enter a luff groove of the mast. With mainsail boom furling, the mainsail is preferably configured to automatically be guided into the mast groove by a pre-feeder so that the sail can be raised smoothly without needing a crew member help to guide the boltrope.

However, as the sail is furled within the boom, the size of the roll of the mainsail within the boom grows. Placing the pre-feeder in line with the luff groove may mean that when the sail is more fully furled within the boom, the sail cannot enter the pre-feeder at a desirable angle. Such an angle might also make it difficult for luff fittings attached to the mainsail adjacent full length battens to emerge from the boom and smoothly transition onto a mast track as the mainsail is unfurled.

Improvements to conventional mainsail pre-feeders are desirable.

For other installations of sails onto masts, such as for storm sails, it may be desirable to have a mast track that is non-linear while still permitting a sail attachment fitting to move along the track. An example of one such sail attachment might be a desire to have a storm sail, such as a trysail, stowed on deck and affixed to the mast. For a single handed or short handed sailor, the storm sail might be preferably immediately available for hoist along a track affixed to the mast. The sail might be connected to the mast and the mast track by an attachment such as a ball-bearing car configured to slide smoothly along the mast track. If such a sail is positioned behind the mast, placement of the storm sail mast track may be problematic due to the conventional linear and rigid or fixed nature of conventional mast track.

Improvements to conventional mast track are desirable.

DESCRIPTION

Figure 1:
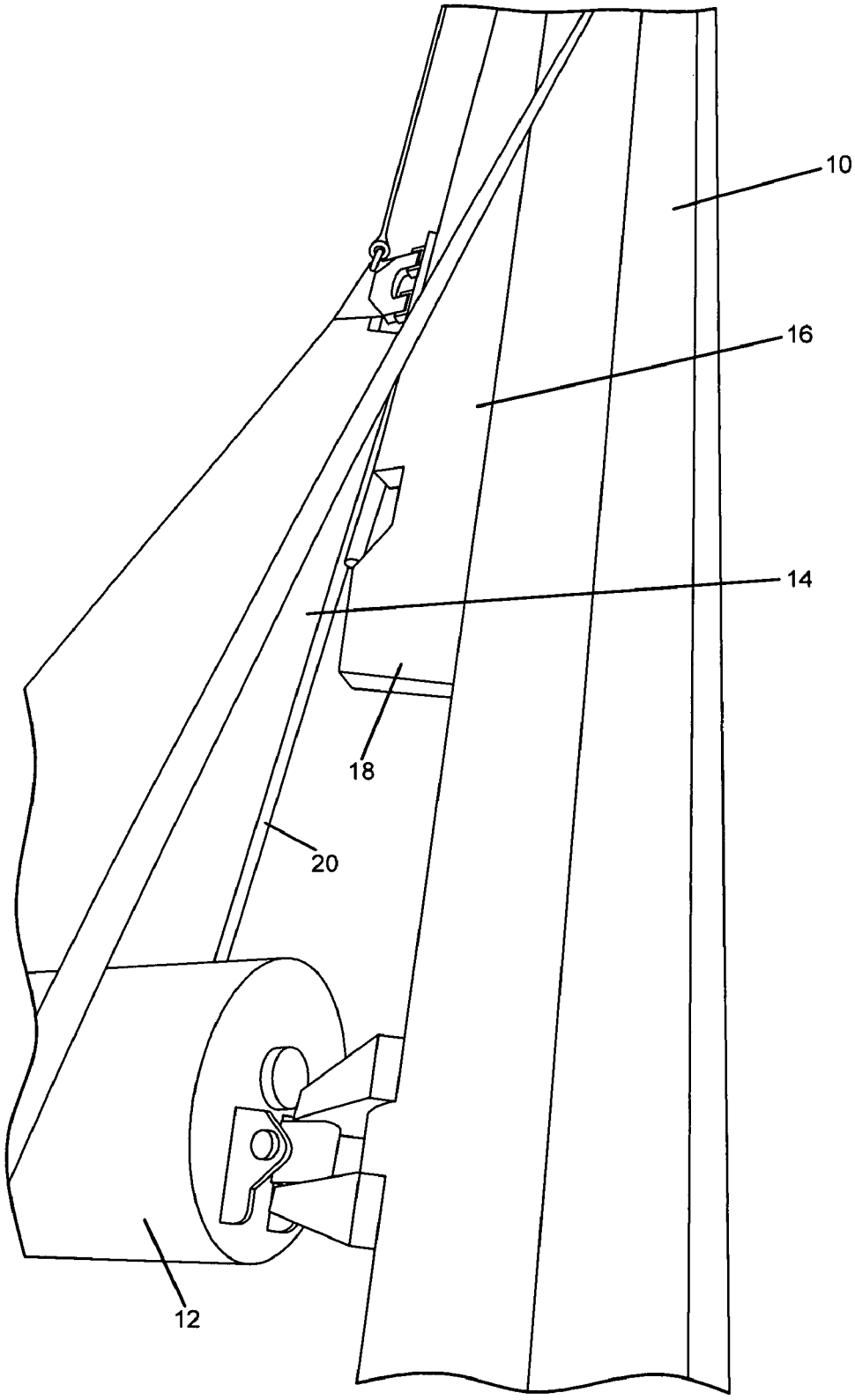
FIG. 1 is a photograph of a conventional mainsail boom furling system with a pre-feeder positioned on an after surface of a mast with the head board of the mainsail held within a mast groove of the pre-feeder.

FIG. 1 illustrates a mast 10 and a boom 12 as installed on a sailboat (not shown). A mainsail 14 is furled within boom 12 by a roller furling system that retracts mainsail 14 within the boom for storage and reefing. A rear extension 16 of mast 10 defines a pre-feeder for entry of a luff 20 of mainsail 14 into a mast groove. As can be seen, the lowest point 18 of rear extension 16 is offset some distance above boom 12. As mainsail 14 is retracted within boom 12, the roll of the mainsail in the furling apparatus increases in diameter. As the roll increases in diameter, a line from the outer surface of the roll to the lowest point 18 of rear extension 16 forms a more acute angle with respect to a centerline of the mast groove. To ensure smooth feeding of mainsail 14 into the mast groove as the mainsail is hoisted requires that lowest point 18 be offset vertically as shown.

While the mast groove could be offset to one side near lowest point 18 to accommodate the more extreme angles formed when mainsail 14 is completely or nearly completely furled, such an arrangement would not be desirable. Any fixed angle of the mast groove would be a compromise between an angle suitable for the most extreme angle when mainsail 14 is furled and the desirable linear arrangement of the mast groove when mainsail 14 is fully or nearly fully hoisted. The distance of vertical separation between boom 12 and lowest point 18 also leaves an undesirable large portion of luff 20 of mainsail 14 unsupported during the hoist of the mainsail and when sailing. Any batten cars positioned along luff 20 would have to pass through the offset before engaging the mast track when hoisting the mainsail.

Figure 2:
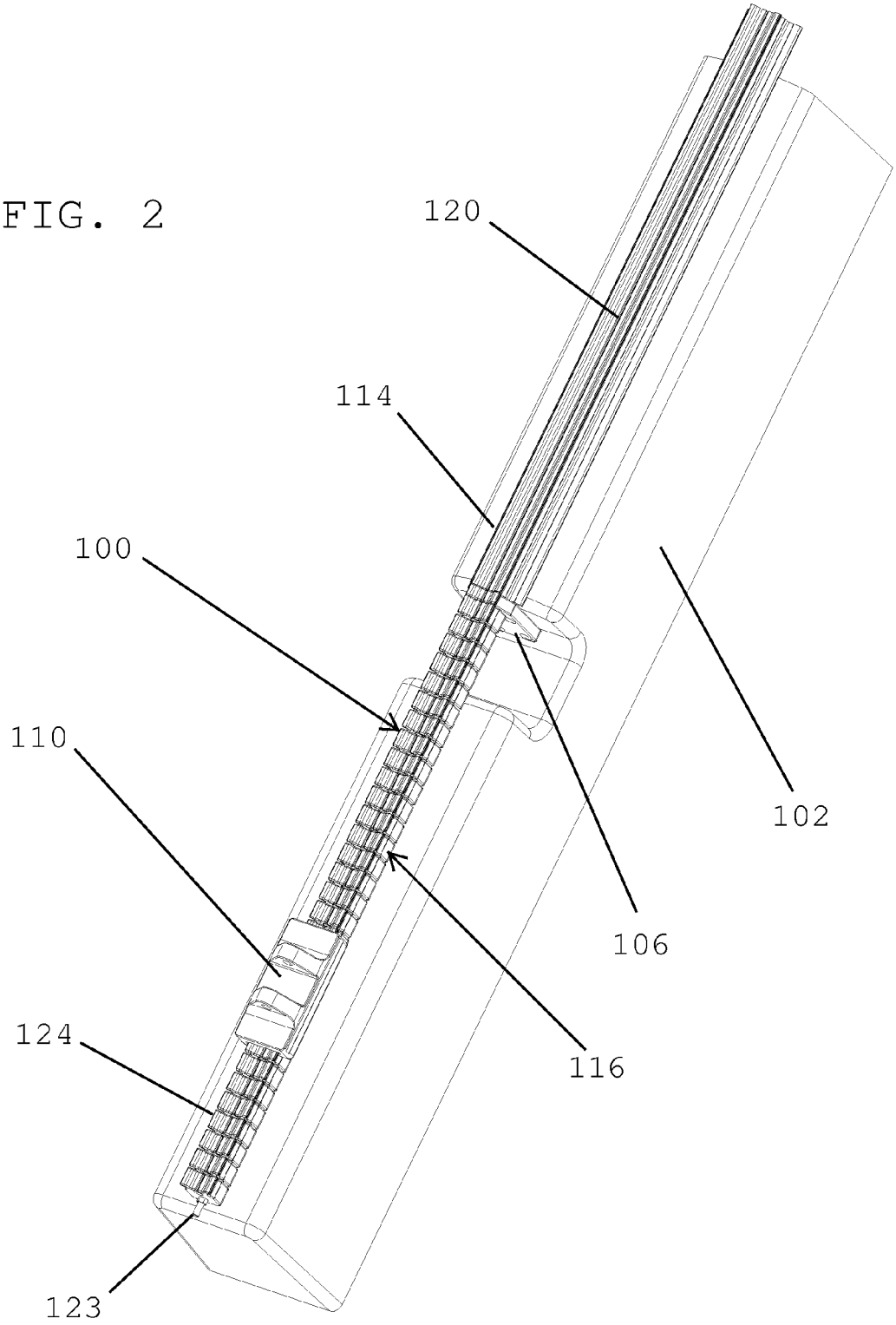
FIG. 2 is a perspective view of a mast track and pre-feeder according to the present disclosure.
Figure 2A:
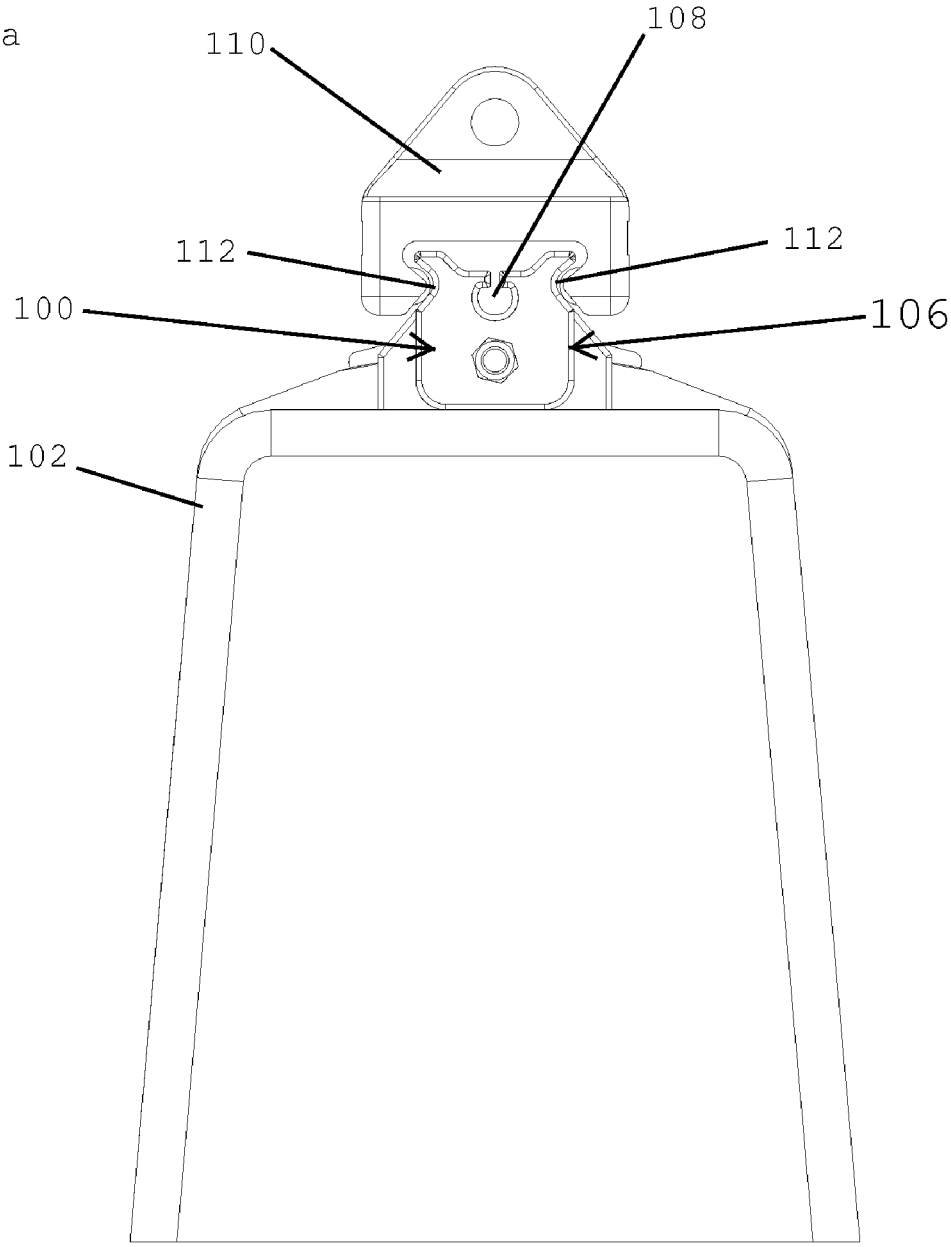
FIG. 2*a* is a side view of the mast track and pre-feeder of FIG. 2.

Referring now to FIGS. 2 and 2*a*, a mast track extension and pre-feeder 100 according to the present disclosure is mounted to a mast portion 102 and extends downward from a lowest point 106. Mast track extension and pre-feeder 100 is preferably sized to extend as close to the boom as possible to ensure that luff 20 of mainsail 14 is as fully supported along its entire length as possible. Extension 100 includes a luff groove 108 and may also include an outer shape configured to receive and permit movement of a batten car 110 or a similar sliding device mounted to the luff of mainsail 14. Such an outer shape or mast track 116 of extension 100 may include opposing recesses 112 which are configured to permit conventional sail control cars to easily slide over the extension to or from a mast track 114 of mast portion 102.

Extension 100 is configured to flex from side to side, permitting luff groove 108 and mast track 116 to deflect a lower end 118 as needed to align with the luff, in whatever condition or degree of furling the mainsail may be in. When mainsail 14 is fully furled, extension 100 would be at its maximum sideways deflection. When mainsail 14 is fully hoisted, lower end 118 would be in line with mast track 114, so that mast tracks 114 and 116 are substantially aligned and so that luff groove 108 of extension 100 is aligned with a luff groove 120 of mast portion 102.

It should be noted that while extension 100 and mast portion 102 each include a luff groove and a mast track, an extension according to the present disclosure does not require both be included. Some boats may not have a mast track, relying purely on a boltrope within the luff groove to hold the sail to the mast, and others will only mount the mainsail to the mast with movable cars sliding on a mast track, so that no luff groove is required.

Figure 3:
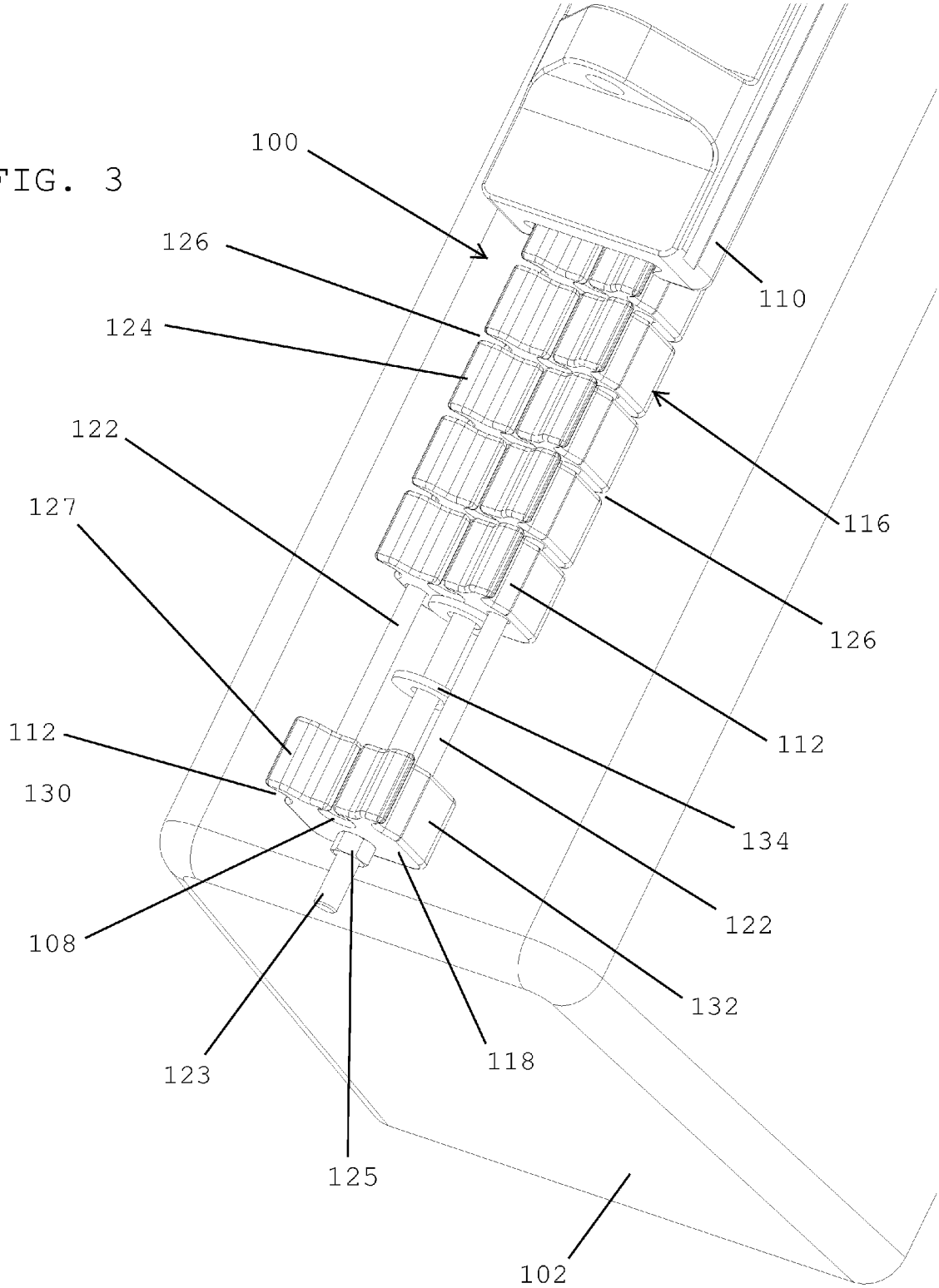
FIG. 3 is a closer view of a lower portion of the mast track and pre-feeder of FIG. 2.

Referring now to FIG. 3, extension 100 may include a plurality of blocks 124 which may be mounted about one or more flexible members 122. A central spine member 123 may be located to provide a primary compression fitting 125 at a lower end. with a cap block 127 as the lowermost block of extension 100. Adjacent blocks 124 define a space 126 between them. A resilient deformable spacer 134 may be placed between adjacent blocks within space 126. In this configuration, it is preferably that blocks 124 be made of a relatively more rigid or less deformable material than any spacers positioned in spaces 126. This rigid feature of the block 124 will permit them to retain a shape suitable to permit movement of batten car 110 or even a similarly configured headboard car (not shown) to move along the extension as the mainsail is raised or lowered.

To deflect side ways, adjacent blocks 124 would tilt with respect to each other so that space 126 along a first side 130 is increased in width while space 126 along an opposite side 132 is decreased. The maximum extent of deflection can be controlled by the width of spaces 126. When blocks 124 along side 132 tilt enough so that adjacent blocks 124 come into contact with each other (closing space 126), extension 100 will not be able to deflect further.

If blocks 124 and 127 are able to be free moved along members 122 and 123 when fitting 125 is removed, any of the blocks or spacers 134 may be removed or replaced to repair or maintain the extension. Members 122 maintain alignment of blocks 124 so that luff groove 108 is consistent along the length of extension 100 and is maintained in alignment with luff groove 120 of the mast. Similarly, mast track 116 of extension 100 is consistent along the length of extension 100 despite the degree of deflection of extension 100 and is maintained in alignment with track 114 of the mast.

Lower end 118 is configured to serve as a pre-feeder for a boltrope or movable cars mounted to mainsail 14, ensuring that the luff of mainsail 14 smoothly moves from within boom 12 onto mast 10 when hoisted. The lowest block 124 may include tapered portions of luff groove 108 and/or mast track 116 to aid the hoisting of mainsail 14.

Members 122 may be configured to provide resistance to fore and aft deflection of extension 100 to provide more precise control to the shape of the foot of the mainsail when hoisted fully or reefed. Alternatively, members 122 may have equal flexibility in all directions so that as mainsail 14 is furled, extension 100 can aid the transition of the luff of the mainsail into the boom.

It is also anticipated that instead of having rigid blocks and flexible spacers, extension 100 could be formed of a consistent material in a single piece. The material is preferably sufficiently deformable to permit the desired degree of deflection of lower end 118. Linear members 122 may or may not be included within such as alternative extension if needed to strengthen the extension or to provide resistance to movement of the extension in one or more directions.

Having a flexible mast track and/or boltrope groove may also be useful for other purposes beyond those associated with mainsail furling systems. As a non-limiting example, a flexible track extension as described herein might be used to mount a storm trysail to a mast, permitting storage of the trysail on deck but permitting it to be hoisted without having to be bent onto the spar. Preferably, such a trysail would be hoisted directly behind the mast. However, in a typical mast and boom configuration, the boom's mounting point to the mast or gooseneck would prevent the trysail from being hoisted from directly below the boom to a point above the boom along the rear of the mast.

A flexible mast track configured similarly to extension 100 may permit a luff of a trysail to be engaged adjacent the deck, be hoisted up to then around the gooseneck of the boom, and brought back to the rear of the mast adjacent track 114 above the boom. Such a flexible track might be used in conjunction with extension 100 to permit the mainsail of a boat to be fully furled and the storm trysail to be hoisted without a crew member having to attend to sail handling at the mast. Such an arrangement might greatly improve speed of preparation for high winds as well as improving crew safety.

Figure 4:
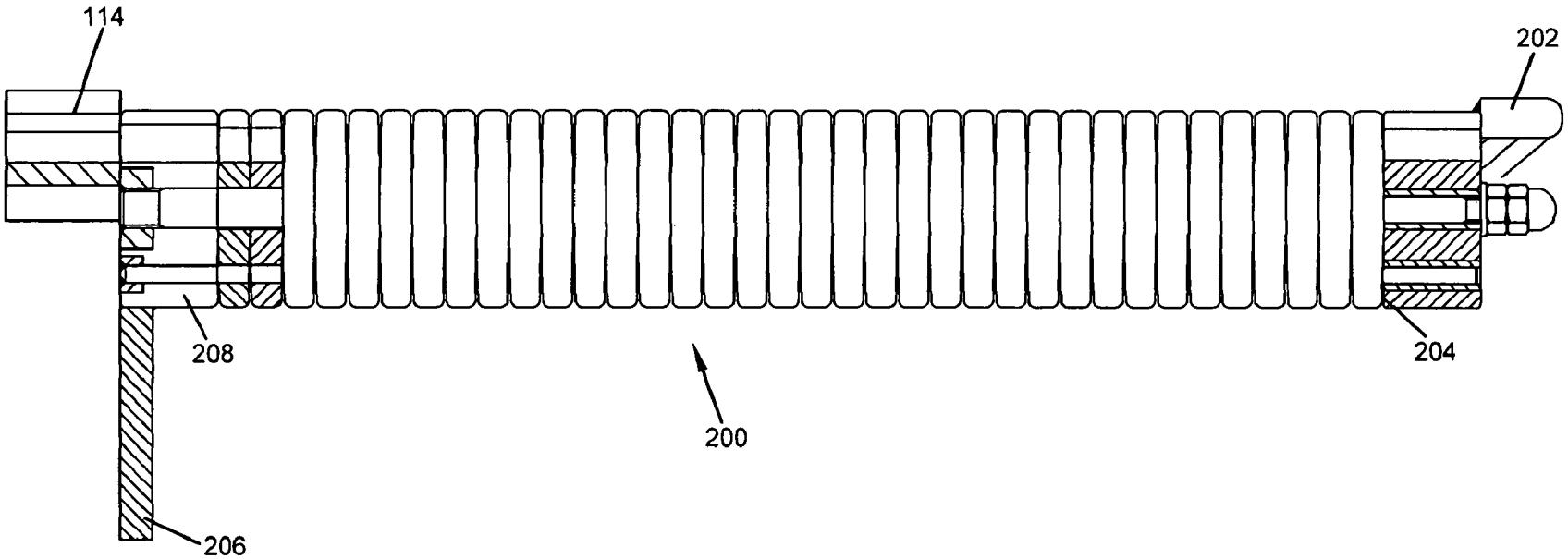
FIG. 4 is a side view of a second embodiment of a mast track extension with pre-feeder according to the present disclosure.
Figure 6:
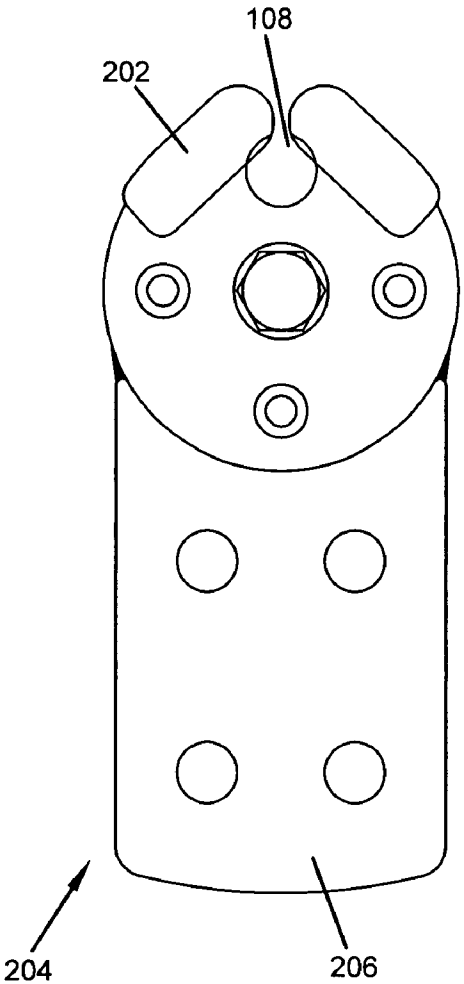
FIG. 6 is a bottom view of the mast track extension of FIG. 4.
Figure 5:
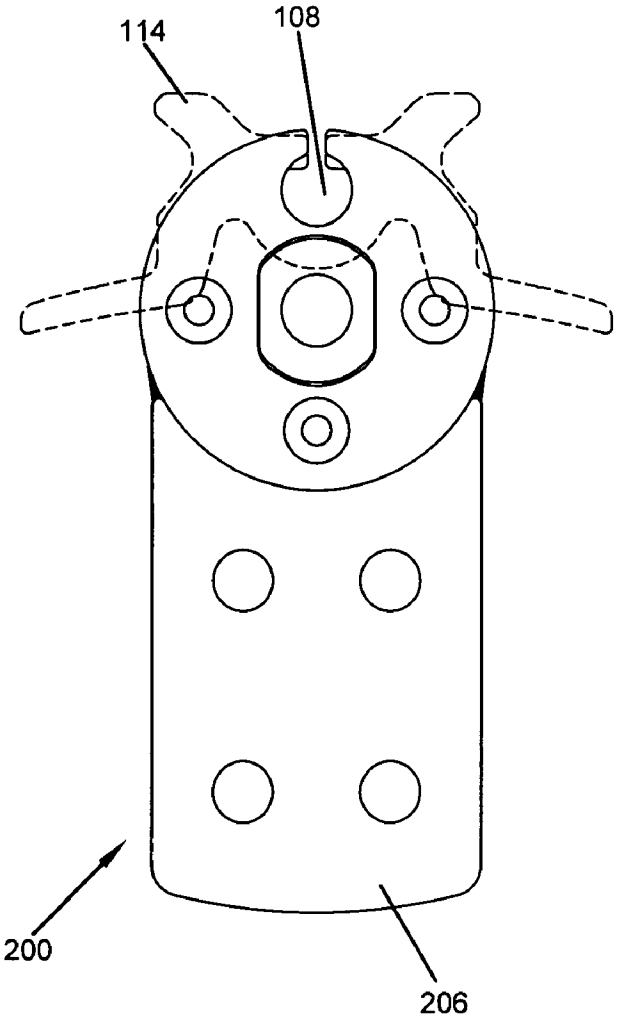
FIG. 5 is a top view of the mast track extension of FIG. 4.

Referring now to FIGS. 4 to 6, a second embodiment 200 of a mast tack extension according to the present disclosure is illustrated with a pre-feeder 202 attached to a bottom or lower end 204. A mounting flange 206 may also be included adjacent a first or top end 208 of extension 200.

The foregoing description is intended to be merely illustrative of the concept embodied in the present disclosure and is not intended to limit the scope of the disclosure. It is anticipated that additional embodiments may be developed within the scope of the present disclosure.

What is claimed is:

1. A flexible mast track extension for use on a sail boat, the flexible mast track extension comprising:

a first end mounted to a rear of a mast adjacent a lower entry to a luff holding arrangement of the mast configured to receive a luff of a mainsail;

a second end extending downward from the first end and defining a lower end positioned adjacent a boom within which is contained the mainsail furled within a boom furling apparatus;

the lower end of the flexible mast extension defining a pre-feeder to ease transition of the luff of the mainsail into a luff holding arrangement of the flexible mast extension and the first end of the flexible mast extension aligning the luff of the mainsail for entry into the luff holding arrangement of the mast;

the lower end of the flexible mast extension deflectable sideways relative to the first end of the flexible mast extension while maintaining the luff holding arrangement of the flexible mast extension in alignment with the luff holding arrangement of the mast.

2. The flexible mast track extension of claim 1, further comprising at least two members extending from the first end to the second end, and a plurality of blocks positioned along the members, the blocks cooperating to define a luff holding arrangement aligned with the luff holding arrangement of the mast, a space defined between each of the blocks with a resilient deformable spacer positioned between the blocks.

3. The flexible mast track extension of claim 2, further comprising a central member with a compression fitting adjacent the second end to hold the blocks in position on the central member and a pair of members extending generally parallel to the central member.

4. The flexible mast extension of claim 1, wherein an outer surface of the flexible mast extension defines a pair of opposing grooves configured to receive a sliding car to which a portion of the luff of a sail is attached.

5. The flexible mast extension of claim 1, wherein the flexible mast extension includes a luff groove.

* * * * *